United States Patent [19]

Whitman

[11] 4,410,045

[45] Oct. 18, 1983

[54] FIREFIGHTING VEHICLE

[75] Inventor: Richard W. Whitman, Vandalia, Ohio

[73] Assignee: Fire Pro, Inc., Springfield, Ohio

[21] Appl. No.: 308,693

[22] Filed: Oct. 5, 1981

[51] Int. Cl.[3] ..... A62C 27/00

[52] U.S. Cl. ..... 169/24; 169/25

[58] Field of Search ..... 169/24, 25; 280/4; 296/63, 64, 24 R; 239/172, 164, 176; 222/608, 612, 526, 527, 533

[56] References Cited

U.S. PATENT DOCUMENTS

| | | | |
|---|---|---|---|
| 394,687 | 12/1888 | Grant | 169/25 |
| 517,320 | 3/1894 | Alexander | 169/25 |
| 527,460 | 10/1894 | Steck | 169/25 |
| 562,895 | 6/1896 | Hayes | 169/25 |
| 645,470 | 3/1900 | Gorter | 169/25 |
| 731,718 | 6/1903 | Steck | 169/25 |
| 1,835,132 | 12/1931 | Anania | 187/11 |
| 3,346,052 | 10/1967 | Moore et al. | 169/25 |
| 3,367,280 | 2/1968 | Bennett et al. | 169/25 |
| 4,269,396 | 5/1981 | Easterwood | 254/325 |

*Primary Examiner*—Joseph J. Rolla
*Assistant Examiner*—Charles C. Compton
*Attorney, Agent, or Firm*—Biebel, French & Nauman

[57] ABSTRACT

A firefighting vehicle comprises a pick-up truck of the type having an open bed, a housing mounted to the floor within the bed and having a plurality of compartments, a tower pivotally mounted to the top of the housing, a rigid conduit pivotally mounted to the top of the housing and extending within and supported by the tower, and a plurality of stabilizing outriggers for stabilizing the truck during operation of the firefighting equipment. The rigid conduit terminates in a nozzle at an upper end and includes a swivel connector proximate the housing to permit rotation of the nozzle to permit water spray to the left or right of the vehicle. When pivoted to a horizontal position, the base of the tower is exposed so that lights mounted on the base shine rearwardly of the truck.

12 Claims, 7 Drawing Figures

104
134
114
102
106
112
136
116
100
92
94
108
88
118
90
124
184
130
132
128
186
126
138
140
168
170
166
58
98
52
188
50
54
190
60
24
56
26
28
20
30
164
182
174
180
172
176
82
178

FIREFIGHTING VEHICLE

BACKGROUND OF THE INVENTION

1. Field of the Invention

The present invention relates to firefighting equipment and, in particular, to firefighting vehicles utilizing a movable tower for supporting a spray nozzle.

2. Prior Art

In fighting grass or brush fires, it is desirable to utilize a firefighting vehicle having a tower which mounts a high pressure nozzle that can be aimed remotely from the top of the tower. By elevating the nozzle above the firefighting vehicle, a much greater area can be traversed by the water discharged from the nozzle then if the nozzle were to be hand-held near the ground. There are many known firefighting vehicles utilizing towers mounting nozzles which can be elevated from a substantially horizontal position, assumed when the vehicle is transported to the sight of the fire, to a substantially vertical position, during which the firefighting equipment supported by the tower is operated.

For example, in U.S. Pat. No. 645,470, a portable water tower is disclosed. This device comprises a wheeled platform which supports a pair of standards which rotatably mount a tower. The tower supports a rigid conduit terminating in an adjustable nozzle at its upper end. The upper section of the conduit is rotatable so that the nozzle can be swiveled to the left or right. The tower is connected to the standards which support it only by a pair of trunnions which must bear the entire weight of the tower.

Other examples of vehicles utilizing water towers are disclosed in U.S. Pat. Nos. 562,895; 527,460; and 1,835,132. The disclosures of these patents are similar in that, in each apparatus disclosed, the tower is mounted on a turntable which is rotatably mounted to a wheeled vehicle. A disadvantage of the use of a turntable with this type of vehicle is that a turntable adds weight and expense to the construction of the vehicle. In addition, firefighting vehicles utilizing turntables usually do not utilize rotatable conduits, so that the entire tower must be rotated by the turntable in order to direct the water discharged from the nozzle. This requires the expenditure of greater amounts of mechanical or manual energy.

Another example is shown in U.S. Pat. No. 517,320. This patent discloses a firefighting vehicle utilizing an aerial ladder which is mounted to a wheeled platform by hinges and can be elevated by a jack screw extending between the ladder and the platform. A hose is mounted on the ladder and includes a section of rigid conduit which terminates in a flexible nozzle connection. The section of rigid conduit can be swiveled with respect to the conduit upstream sections of the conduit in order to direct the nozzle. A disadvantage with this type of construction is that the ladder provides a small base of support which results in instability of the ladder structure. The ladder structure may rock with respect to the supporting platform while the supported conduit conducts water under high pressures, which lessens the accuracy of the nozzle and creates hazards to personnel operating the device.

When fighting brush and grass fires, it is also desirable to utilize a vehicle for transporting the water tower which is small, rugged, and maneuverable. None of the aforementioned patents discloses a vehicle for transporting a water tower which can operate in a rugged terrain. Indeed, in many of the aforementioned disclosures, the vehicle for transporting the water tower must be pulled by a second motorized vehicle. In addition, the aforementioned vehicles are not sufficiently self-contained to provide an adequate firefighting station in a remote area. For example, none of them disclose the use of stabilizing means for the platform supporting the tower, or illuminating means for providing illumination during poorly lit firefighting conditions where it is necessary to provide an adequate light level so that personnel can avoid dangerous structures and can attend to smoking or smoldering objects which themselves do not give off light.

Accordingly, there is a need for a firefighting vehicle having a tower which supports a conduit having a nozzle which can be remotely adjusted, the water tower providing a large, stable base for supporting the conduit when raised to a vertical position, a vehicle which can traverse and operate in a rugged terrain, and a firefighting vehicle which is essentially self-contained.

SUMMARY OF THE INVENTION

The present invention provides a firefighting vehicle which is especially adapted for fighting brush and grass fires in rugged terrain and under adverse conditions. The invention includes a water tower which can be moved to a substantially horizontal position to facilitate transportation, and can be raised to a substantially vertical position with relatively little effort, and provides a sturdy support base for a supported high pressure nozzle, providing support throughout a 360° radius of operation. In addition, the firefighting vehicle of the present invention is substantially self-contained in that it includes means for illuminating the area traversed by the spray from the nozzle, and includes storage compartments for equipment. The firefighting vehicle of the present invention can utilize a standard, open bed, pick-up truck and therefore provide a relatively small, lightweight, mobile firefighting unit.

The present invention utilizes a pick-up truck of the type having a roofed cab, side walls, a rear wall, and a floor defining an open bed. A housing which defines a plurality of compartments and includes a top surface is mounted to the floor within the bed of the truck, preferably adjacent the rear wall. A tower is pivotally mounted to the top surface of the housing and is capable of pivoting from a substantially horizontal position, in which the tower extends over the roof of the cab, to a substantially vertical position. The tower supports a rigid conduit which is rotatably mounted to the top surface of the housing and extends through a top plate of the tower. The rigid conduit includes a swivel connection which is positioned to permit manual positioning of the nozzle by an operator positioned adjacent the rear of the truck. The lower portion of the conduit terminates in a Y-connection so that two flexible hoses may feed the rigid conduit. The Y-connection includes check valves to prevent water flow from one supply hose back through the other supply hose.

The vehicle of the present invention also includes stabilizing means which consists of outriggers extending outwardly from the sides and rear of the truck bed. The outriggers are designed to be swung into storage positions when not in use to facilitate transportation of the vehicle.

The tower also supports an electrical conduit which powers floodlights mounted on the top plate. The electrical conduit may also power additional lights along the tower and other electrical equipment such as sirens.

The tower has a substantially rectangular base which provides a sturdy support for the nozzle and conduit, regardless of the direction in which the reactive forces caused by the high pressure water flow act. The tower preferably is hinged at a forward edge of the rectangular base and includes connecting knuckles attached to a rearward edge so that the base can be pivoted from its horizontal position to its vertical position and locked in place. An additional advantage of the rectangular base is that lights may be mounted on the rearward edge of the base so that, when the tower is moved to its horizontal position, the lights on the rearward edge can shine to the rear of the vehicle at a position above the bed of the truck, thereby providing an additional safety feature.

Another advantage of the present invention over the prior art is that the housing which supports the tower is constructed to be placed within the bed of a standard pick-up truck and bolted to the I-beams of the truck which support the bed. The housing also can include a number of compartments for storing firefighting equipment, compressors, pumps, or even for storing water to be sprayed by the nozzle. Because of the size and location of the housing in a preferred embodiment of the invention, a frame supporting a pair of jump seats may be provided and positioned within the bed adjacent the cab so that additional personnel can be transported to the site of the fire in the vehicle.

Accordingly, it is an object of the present invention to provide a firefighting vehicle which utilizes a standard pick-up truck and can traverse and operate in rugged terrain; a vehicle which utilizes a water tower which can be raised with a minimum of effort and provide adequate support for the nozzle throughout a 360° range of operation; and a vehicle which is essentially self-contained and can provide illumination for hazardous low-light conditions.

Other objects and advantages of the invention will be apparent from the following description, the accompanying drawings and the appended claims.

DETAILED DESCRIPTION OF THE PREFERRED EMBODIMENT

Figure 1:
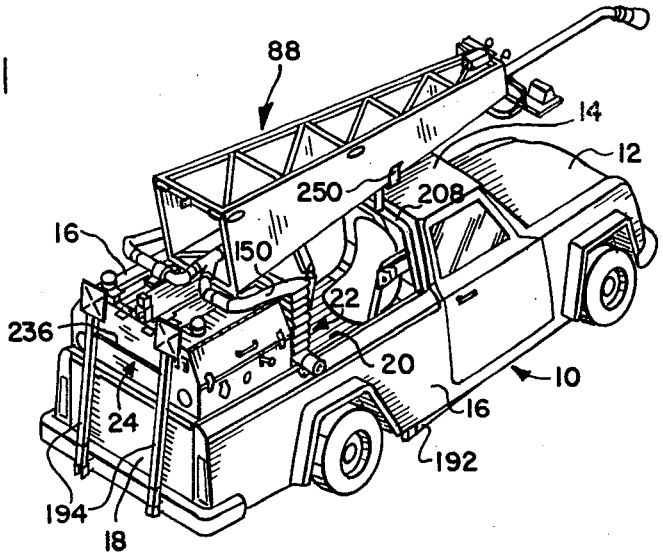
FIG. 1 is a perspective view of a firefighting vehicle of the present invention in which the water tower is in a horizontal position.
Figure 2:
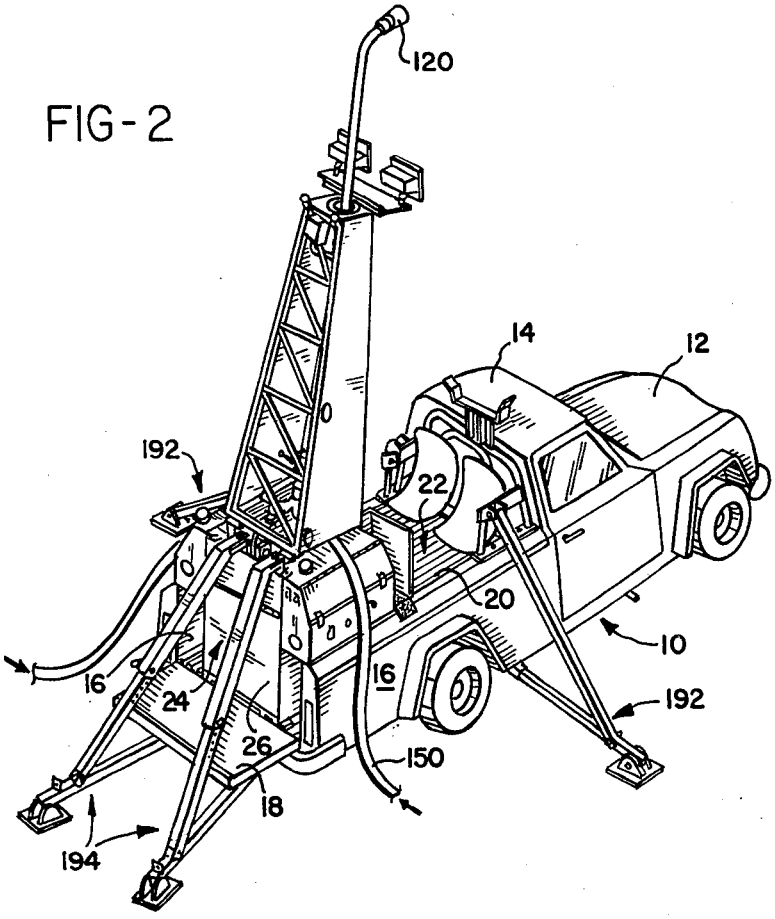
FIG. 2 is a perspective view of the vehicle of FIG. 1 in which the water tower is in a vertical position and the outrigger supports are in position.

As shown in FIGS. 1 and 2, the firefighting vehicle of the present invention, generally designated 10, utilizes a standard pick-up truck 12 having a roofed cab 14, side walls 16, a rear drop gate 18, and a floor 20. The cab 14, side walls 16, drop gate 18, and floor 20 together define an open bed 22. The pick-up truck 12 can be of any manufacture and preferably is in the one-quarter to one ton load range.

Figure 3:
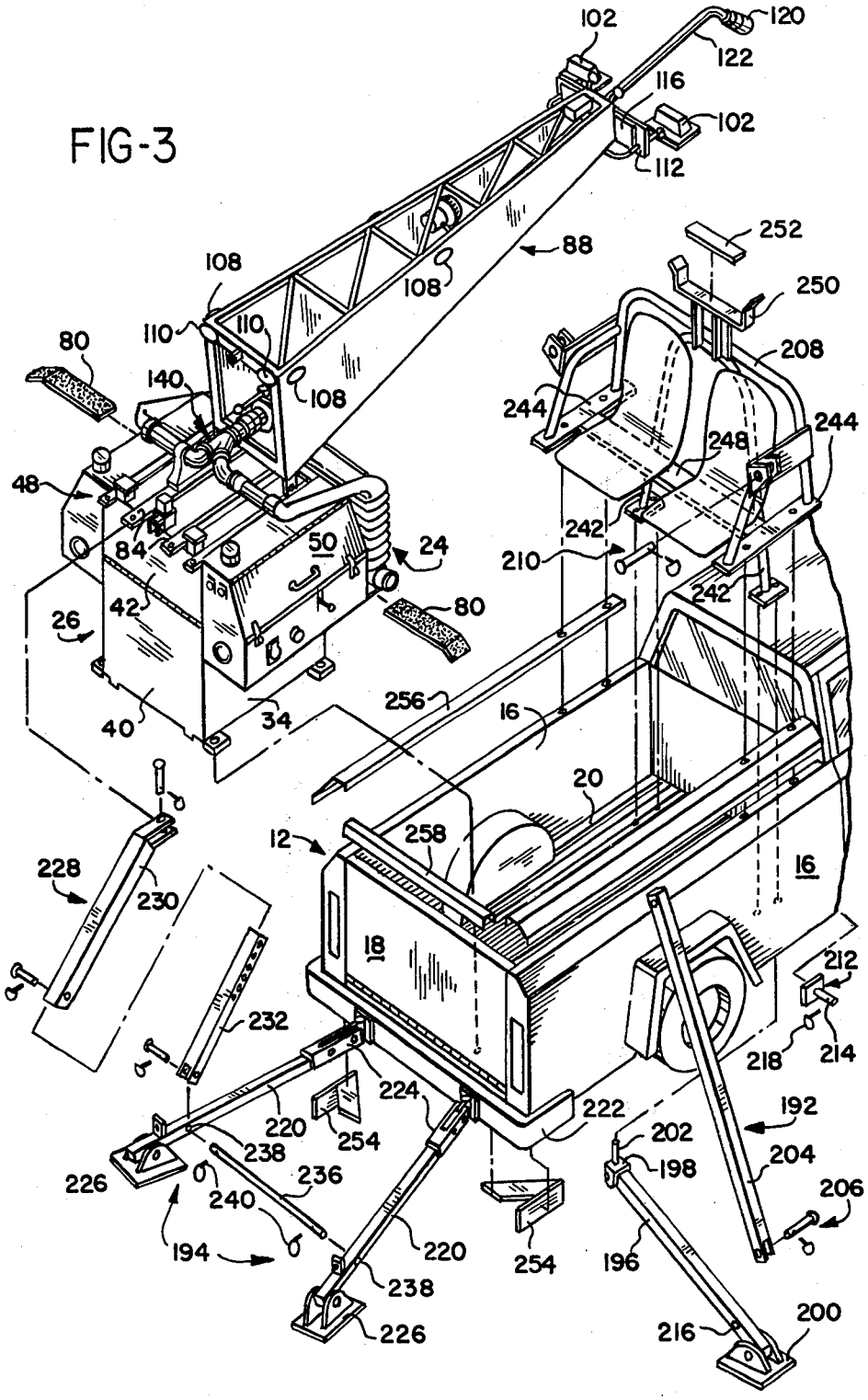
FIG. 3 is an exploded detail view of the vehicle of FIG. 1 showing the bed of the truck and the water tower apparatus.
Figure 5:
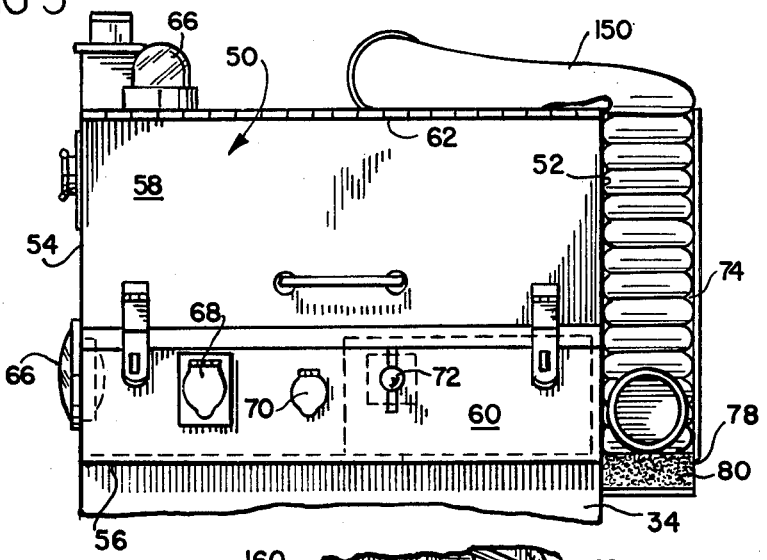
FIG. 5 is a detail view of the side of the housing showing the hose storage compartment.
Figure 4:
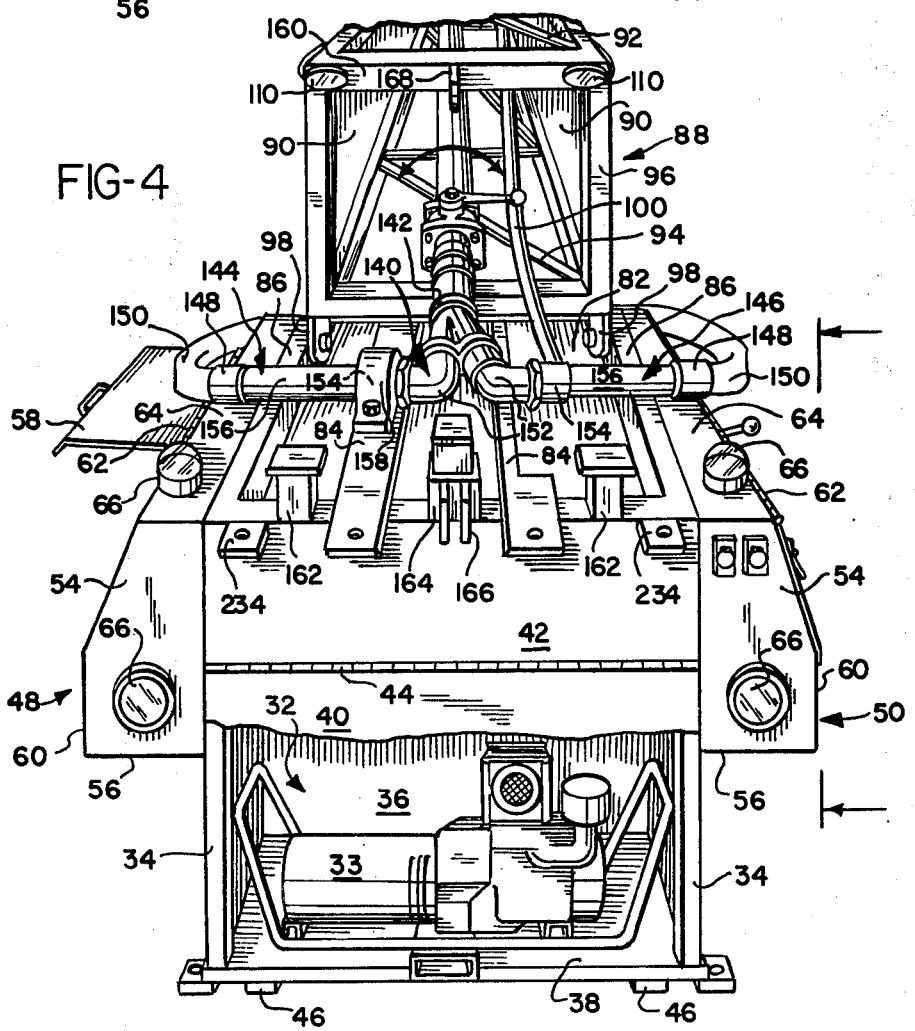
FIG. 4 is a perspective view of the rear of the housing of the invention, with a door of a rear compartment partially broken away to reveal the interior of the rear compartment.
Figures 6, 7:
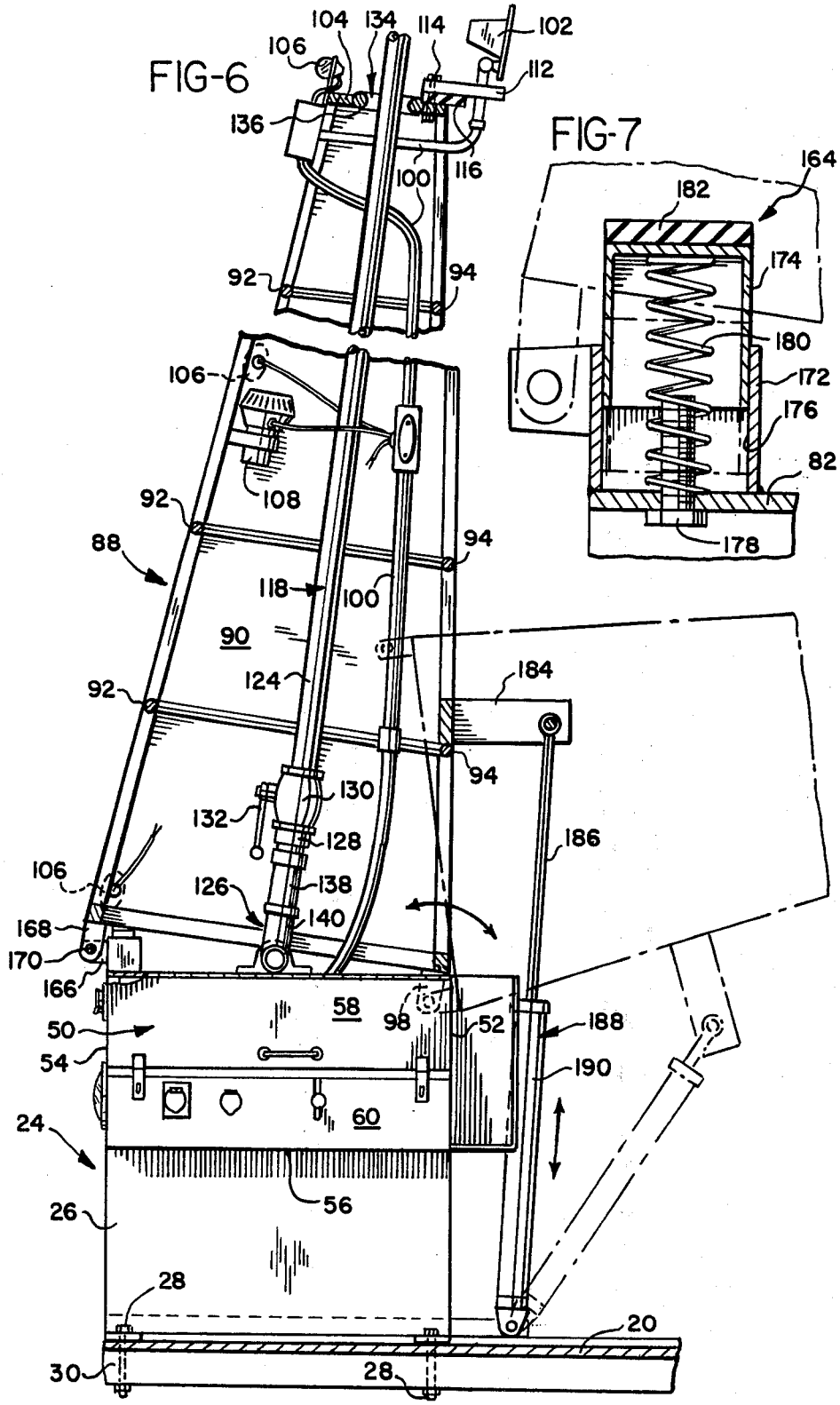
FIG. 6 is a detail side elevation of the invention showing the housing, a fragmentary elevation of the tower in section, and the tower rotated to a horizontal position in phantom.
FIG. 7 is a detail elevation, in section, of a resilient stop of the invention.

A housing 24 is mounted in the bed 22 of the truck 12, preferably adjacent the drop gate 18. As shown in FIGS. 2 and 6, the housing 24 includes a lower compartment 26 which preferably is mounted to the floor 20 by bolts 28 which attach to the I-beams 30 beneath the bed of the truck 12. As shown in FIGS. 3 and 4, the lower compartment 26 of the housing 24 may contain a storage area 32, containing, for example, a compressor, 33, which is defined by the upright walls 34, front wall 36, bottom 38, and rear door 40 which is attached to a rear wall 42 of the housing by a piano hinge 44. The bottom 38 may also includes strakes 46, which extend from the rear door 40 to the front wall 36 and are sized to engage the corrugations formed in the floor 20 of the bed 22.

As shown in FIGS. 3-6, the housing 24 also includes two side compartments 48, 50, each attached to a different upright wall 34. Each side compartment 48, 50 includes front and rear walls 52, 54, bottom walls 56, and hinged doors 58. The hinged doors 58 engage lateral walls 60 at their lower ends and are attached by hinges 62 to top walls 64. The side compartments also provide a support for various lights 66 and an interface between the internal circuitry and an external power source. For example, the lateral walls 60 can support an external power source recepticle 68, a safety switch 70, and a solenoid switch 72 for the hydraulics of the vehicle 10.

The front wall 36 of the housing 24 supports a hose compartment 74 defined by a front compartment wall 76 and bottom compartment wall 78. The bottom compartment wall 78 preferably includes a non-skid surface 80 which may be provided in the form of an insert (shown in FIG. 3).

As shown in FIGS. 3 and 4, the housing 24 includes a top surface 82 to which is attached support beams 84 which extend longitudinally across the top surface from the rear wall 42 to the front wall 36. The top surface 82 is also bounded by a support frame 86 which abuts the side compartments 48, 50. A water tower 88 includes upwardly converging side walls 90, a rear wall made up of zig-zag trusses 92, and a front wall (shown in FIG. 6) also made up of zig-zag trusses 94. The side walls 90 and front and rear trusses 92, 94 extend upwardly from a rectangular base 96 which is attached to the support frame 86 by hinges 98.

The tower 88 supports an electrical conduit 100 which supplies electric power to floodlights 102, mounted on a top plate 104 of the tower. The electrical conduit 100 communicates with a source of electric power (not shown) such as a generator, and also supplies power to other electrical fixtures mounted within the tower 88 such as lights 106 and a siren 108. The conduit 100 also powers rear tower lights 110 which are mounted to the base 96 of the tower 88.

The floodlights 102 preferably are mounted to a platform 112 by conventional means. The platform 112 is preferably mounted to the top plate 104 by bolts 114 and the mounting incorporates a vibration damping means such as a rubber gasket 116.

Extending within the tower 88 is a rigid conduit 118 which terminates in a pressure nozzle 120 at an upper end 122. The conduit 118 includes an upper portion 124 and a lower portion 126 which are joined at a swivel connection 128. The upper portion 124 includes a butterfly valve 130 having a valve handle 132 oriented so that the valve handle is at right angles to the conduit 118 when the valve is in the opened or closed position, as shown in FIG. 4.

The upper portion 124 of the conduit 118 extends through an opening 134 which is centrally located in the top plate 104 of the tower 88. The opening 134 is surrounded by a cushion 136 to provide support for the conduit 118 when it is reacted against the tower 88.

As shown in FIGS. 3, 4, and 6, the lower portion 126 of the conduit 118 includes a stream straightener 138 of conventional design and terminates in a Y-connection 140. The root 142 of the Y-connection communicates with the lower portion 126 of the conduit 118 and the legs 144, 146 terminate in quick-disconnects 148 which may receive flexible hoses 150 of conventional design. The legs 144, 146 each include elbows 152 which are joined to check valves 154 which in turn are joined to straight sections 156 which terminate in the quick-disconnects 148. The check valves 154 are oriented within their respective straight sections 156 such that fluid flow from the root 142 to the quick-disconnect 148 is prevented. Thus, fluid within the straight sections 156 may only flow in a direction from the quick-disconnects 148 to the root 142.

The straight section 156 of one of the legs 144 is pivotally mounted to a support beam 84 by a pillow block bearing 158. The straight sections 156 of the legs 144, 146 are aligned such that their central longitudinal axes are co-linear. Thus, the common central longitudinal axis of the legs 144, 146 coincides with an axis of rotation of the conduit 118 about the pillow block bearing 158.

As shown in FIGS. 3, 4, and 6, the tower may be rotated to a vertical position in which a rear member 160 of the base 96 engages stops 162 which are mounted to the support frame 86 of the housing 24. A resilient member 164 is mounted to the support frame 86 midway across the width of the housing 24 and includes a U-bracket 166 which receives a knuckle 168, mounted on the rear member 160, to retain the tower 88 in the vertical position. The U-bracket 166 is secured to the knuckles 168 by conventional means such as a bolt and cotter pin combination 170.

As shown in FIG. 7, the resilient member 164 includes a cylindrical casing 172 which receives a piston 174 sized to slide against an inner wall 176 of the casing. The casing 172 is welded to the top surface 82 of the housing 24 and surrounds an adjustable bolt 178 which acts to center a coil spring 180 within the casing 172. The coil spring 180 urges against the top surface 82 and the piston 174, thereby urging the piston upwardly against the base 96 of the tower 88. The piston 174 preferably includes a pad 182 made of a hard rubber to provide a vibration isolating means.

As shown in FIG. 6, the tower 88 includes a flange 184 which is mounted to the front trusses 94. The flange 184 is rotatably connected to the rod 186 of a double-acting cylinder 188. The body 190 of the cylinder 188 is rotatably mounted to the floor 20 of the truck. Thus, by actuating the cylinder 188 so that the rod 186 extends outwardly from the body, the tower 88 is caused to pivot about the hinges 98 rearwardly until the rear member 160 engages the stops 162. When the cylinder 188 is actuated so that the rod 186 retracts into the body 190, the tower 88 is forced to pivot about hinges 98 toward a substantially horizontal position so that the upper portion of the tower overhangs the cab 14 of the truck 12, as shown in FIG. 1.

As shown in FIGS. 2 and 3, the vehicle 10 includes stabilizing members consisting of lateral outriggers 192 and rear outriggers 194. Each lateral outrigger 192 includes a leg 196 connected to a swivel hinge 198 at an inner end and rotatably connected to a foot pad 200 at an outer end. The swivel hinge 198 includes a bolt 202 which is rotatably mounted beneath the truck 12 thereby permitting pivotal movement of the leg 196; that is, movement of leg 196 freely in a vertical plane and a horizontal plane. The lateral outriggers 192 also include a strut 204 which is rotatably mounted to the leg 196 by a bolt and cotter pin combination 206 at an outer end and is connected to a jump seat frame 208 at an inner end by a bolt and cotter pin combination 210. The jump seat frame 208 will be discussed subsequently in greater detail.

A mounting pin 212 is welded to the underside of the truck 12 and includes a pin 214 sized and positioned to engage a through hole 216 formed in the leg 196. Thus, the lateral outriggers may be dismantled and folded away during transportation by removing the strut 204 from the leg 196 and jump seat frame 208, then pivoting the leg so that the through hole engages the pin 214 and is retained therein by cotter pin 218.

The rear outriggers 194 each consist of a rear leg 220 which is pivotally attached to a rear bumper 222 of the truck 12 by a hinge and clevis combination 224 at an inner end. The outer ends of the rear legs 220 are rotatably attached to rear foot pads 226.

The rear outriggers 194 also include adjustable telescoping struts 228, each consisting of an outer sleeve member 230 and an inner sleeve member 232. The outer sleeve member 230 is rotatably mounted at an inner end to a support beam 84. The outer portion of the inner member 232 of the adjustable telescoping strut 228 is rotatably connected to the rear leg 220 adjacent the foot pad 226. Thus, when not in use, the rear outriggers may be folded upwardly from the ground and stored. This is accomplished by first removing the adjustable telescoping struts 228 from between the rear legs 220 and support beams 84, then attaching the rear legs to the extensions 234 of the support frame 86 best shown in FIG. 4. In order to achieve greater stability of the rear outriggers 194 when in the storage position, a stabilizing bar 236 may be attached between them by inserting the ends of the bar into holes 238 and securing them by pins 240.

As shown in FIG. 3, the jump seat frame 208 includes legs 242 which are bolted to the floor 20, and side stabilizers 244 which are bolted to the side walls 16 of the truck 12. A pair of jump seats 246 is mounted to a cross bar 248 extending between the side stabilizers. The jump seat frame 208 includes a tower rest 250 having a mounting pad 252. The tower rest 250 extends upwardly from the top of the jump seat frame and provides a support for the tower 88 when rotated to a substantially horizontal position.

As shown best in FIG. 6, it is preferable to provide reinforcing for the truck 12 to enable it to withstand the additional loading of the firefighting equipment and to strengthen those portions which may receive excessive wear in field use. Accordingly, side wedges 254 are provided which are welded beneath the ends of the side walls 16 adjacent the drop gate 18 and beneath the rear bumper 222. Side sheathings 256 are provided to protect the tops of the side walls 16. Rear sheathing 258 is attached to the top portion of the drop gate 18. Side sheathings 256 and rear sheathing 258 preferably are made of a wear-resistant and slip-resistant material to absorb high impact loads. In addition, it may be preferable to add reinforcing structure to the suspension of the vehicle 12, such as an additional leaf spring or heavy-duty shock absorbers and springs. Additional reinforcing means may be provided for the pick-up truck and still fall within the scope of the invention.

The operation of the firefighting vehicle 10 is as follows. When being transported to the site of the fire, the vehicle is in the configuration shown in FIG. 1. The tower 88 has been rotated downwardly by the cylinder 188 so that it engages the tower rest 250 of the jump seat 208. The lateral outriggers 192 have been pivoted into their transportation and storage positions beneath the side walls 16 of the truck, and the rear outriggers 194 have been rotated to their upward transportation positions, and are joined by stabilizng bar 236. The hose 150 is coiled in the hose compartments 74 of the housing 24.

When the firefighting vehicle 10 arrives at the scene of the fire, the lateral outriggers 192 and rear outriggers 194 are displaced from their traveling positions and are extended as shown in FIG. 2. The drop gate 18 is lowered to expose the rear door 40 of the lower compartment 26 which permits access to the equipment therein. The hoses 150 are removed and connected to the quick-disconnects 148 of the Y-connection 140 and are attached to sources of pressurized water (not shown). The tower 88 is raised by actuating the double-acting cylinder 188 and the U-bracket 166 of the support frame 86 is attached to the knuckle 168 of the rear member 160 by pin 170, thereby locking the tower in place. As the tower is rotated to its upward position, the rigid conduit 118 also is rotated about the common longitudinal axis of the straight sections 156.

When the tower has been locked in place, the valve 130 is opened, allowing pressurized water to exit the nozzle 120. The nozzle 120 and upper portion 124 of the conduit can be rotated in a 360° direction by manually grasping the valve handle 132 of the butterfly valve 130 and rotating or swiveling the upper portion.

When the vehicle 10 is no longer needed at the site of the fire, the tower is displaced for traveling by removing the pin 170 and permitting the resilient member 164 to urge the tower forward, thus helping the double-acting cylinder to pivot the tower to a substantially horizontal position. The lateral and rear outriggers 192, 194 are again adjusted to their traveling positions, and the vehicle 10 is then ready to be transported to another location.

While the form of apparatus herein described constitutes a preferred embodiment of this invention, it is to be understood that this invention is not limited to this precise form of apparatus, and that changes may be made therein without departing from the scope of the invention.

What is claimed is:

1. A firefighting vehicle comprising:

a pick-up truck of the type having a roofed cab, side walls, a rear wall, and a floor defining a bed;

a housing defining a plurality of compartments and having a top surface, said housing mounted on said floor within said bed;

a rigid tower having a substantially rectangular base pivotally attached to said top surface at a forward portion thereof and capable of pivoting from a substantially vertical, operational position forwardly to a substantially horizontal, storage position;

means for pivoting said tower between said horizontal and said vertical positions;

rigid conduit means pivotally attached to said top surface rearwardly of said forward portion of said tower and having a lower end for communication with fire hose means and terminating in nozzle means at an upper end, said conduit means extending within and slidably supported by said tower such that said conduit means is pivoted by movement of said tower between a substantially horizontal position and a substantially vertical position.

2. The vehicle of claim 1 wherein said base includes a rearward side having light means positioned thereon such that said light means face rearwardly of said vehicle and are located above said housing when said tower is in said horizontal, stored position.

3. The vehicle of claim 2 wherein said conduit means includes swivel joint means located intermediate said upper and lower ends such that an upper section of said conduit means intermediate said swivel joint means and said nozzle means may be swiveled with respect to said tower and a lower section of said conduit means intermediate said swivel joint means and lower end.

4. The vehicle of claim 3 wherein said lower end of said conduit means includes Y-connector means having a root connected to said lower section, a first leg and a second leg extending transversely of said top surface, said first and second legs each attached to said top surface for pivotal movement about an axis transverse to said top surface.

5. The vehicle of claim 4 wherein said top surface further comprises:

block means for engaging said rearward side when said tower is in said vertical position; and resilient means for urging said tower to rotate from said vertical position.

6. The vehicle of claim 5 wherein said pivoting means comprises a double-acting cylinder extending between said floor and a forward portion of said tower.

7. A firefighting vehicle comprising:

a pick-up truck of the type having a roofed cab, side walls, a rear wall, and a floor defining a bed;

a housing defining a plurality of compartments and having a top surface, said housing mounted on said floor within said bed;

a tower having a substantially rectangular base with a forward side having hinge means pivotally mounting said tower to said top surface such that said tower may be pivoted from a substantially vertical position to a substantially horizontal position whereby said tower extends forwardly of said cab;

said base having a rearward side including light means positioned thereon such that said light means face rearwardly of said vehicle and are located above said housing when said tower is in said horizontal position;

means for pivoting said tower between said vertical and said horizontal positions;

rigid conduit means having Y-connector means at a lower end thereof, said Y-connector means including a root connected to a lower section of said conduit means, and first and second legs extending transversely of said top surface in opposite directions along a common central longitudinal axis and having check valve means therein for preventing fluid flow therethrough away from said conduit means;

said conduit means including nozzle means at an upper end thereof and extending within and supported by said tower;

bearing means attached to said top surface and supporting said legs for pivotal movement about said longitudinal axis;

block means for engaging said rearward side of said base when said tower is in said vertical position;

resilient means for urging said tower to rotate from said vertical position; and outrigger means for stabilizing said truck.

8. The vehicle of claim 7 wherein said outrigger means comprises:

at least two lateral outrigger elements each extending outwardly from a different side of said truck and having side leg means pivotally connected to an underside of said truck at an inner end and terminating in a pad at an outer end, a strut removably and rotatably mounted to said truck above an associated one of said side legs at an end and removably and rotatably attached to said leg approximate said pad;

at least one rear outrigger element, having rear leg means pivotally attached to a rear surface of said truck at an inner end and having an outer end terminating in a pad, and rear strut means removably and rotatably connected to said housing at an end and removably and rotatably connected to said rear legs means adjacent said pad;

means for removably securing said rear leg to said housing adjacent said pad; and means for removably securing said outer ends of said side leg means to said underside.

9. The vehicle of claim 8 further comprising jump seat structure comprising:

a frame sized to be mounted within said bed forwardly of said housing;

at least one jump seat mounted to said frame;

means extending upwardly from said frame for supporting said tower in said horizontal position; and means associated with said frame for removably mounting said side struts.

10. The vehicle of claim 6 further comprising:

at least one top light means mounted to said tower proximate said nozzle; and electrical conduit means extending within said tower and communicating with said top light means and a source of electrical power.

11. The vehicle of claim 6 wherein said tower further includes a top plate having an opening for receiving said rigid conduit means therethrough, said top plate having cushion means about said opening to provide a bearing surface for abutment by said conduit.

12. The vehicle of claim 6 further comprising:

first and second flexible hose means, each removably attached to a different one of said first and second legs; and means associated with a forward portion of said housing defining hose storage space for said first and second hose means.

* * * * *